US007696440B2

(12) United States Patent
Kuo

(10) Patent No.: US 7,696,440 B2
(45) Date of Patent: Apr. 13, 2010

(54) FLEXIBLE FLAT CABLE WITH IMPROVED EASY STRUCTURES FOR ENGAGEMENT/DISENGAGEMENT

(75) Inventor: Peter Kuo, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 220 days.

(21) Appl. No.: 11/888,793

(22) Filed: Aug. 2, 2007

(65) Prior Publication Data

US 2008/0029290 A1 Feb. 7, 2008

(30) Foreign Application Priority Data

Aug. 2, 2006 (CN) ..... 2006 2 0075533

(51) Int. Cl.
*H01B 7/00* (2006.01)

(52) U.S. Cl. ..... 174/117 R; 174/117 F; 174/117 FF

(58) Field of Classification Search ..... 174/110 R, 174/113 R, 117 R, 117 F, 117 FF; 439/492, 439/466

See application file for complete search history.

(56) References Cited

U.S. PATENT DOCUMENTS 3,114,587 A * 12/1963 Herrmann ..... 439/329
4,357,750 A * 11/1982 Ostman ..... 29/847
5,015,197 A * 5/1991 Redmond et al. ..... 439/329
5,281,765 A * 1/1994 Iura et al. ..... 174/117 F
5,403,202 A * 4/1995 Roehling ..... 439/493
5,834,701 A * 11/1998 Saka et al. ..... 174/117 F
6,039,600 A * 3/2000 Etters et al. ..... 439/496
6,558,186 B1 * 5/2003 LePottier et al. ..... 439/496
6,688,911 B2 * 2/2004 Fuerst et al. ..... 439/496
6,927,343 B2 * 8/2005 Watanabe et al. ..... 174/254

FOREIGN PATENT DOCUMENTS

JP 2003-036907 2/2003

* cited by examiner

*Primary Examiner*—William H Mayo, III
(74) *Attorney, Agent, or Firm*—Wei Te Chung; Andrew C. Cheng; Ming Chieh Chang

(57) ABSTRACT

A flexible flat cable (10) is adapted for mating with a complementary connector (70). The flexible flat cable (10) includes a number of conductors (20) parallelly disposed, an insulation jacket (30) covering said conductors (20); and an insert portion (40) form at one end of the flexible flat cable (10) with the conductors (20) exposed outside the insert portion (40); a chamfer (201) is formed on the end of the conductors (20) located in the insert portion (40).

13 Claims, 5 Drawing Sheets

FLEXIBLE FLAT CABLE WITH IMPROVED EASY STRUCTURES FOR ENGAGEMENT/DISENGAGEMENT

BACKGROUND OF THE INVENTION

1. Field of the Invention

The present invention generally relates to a flexible flat cable (FFC), and more particularly to a flexible flat cable easily inserted into and pulled out from the complementary connector.

2. Description of Related Art

Flexible Flat Cable (FFC) used as a signal transmission component has advantages of arbitrary deflection, high-speed signal transmission, etc. It has been widely used in many electrical products and can directly engage with and disengage from the complementary connector. JP Public Patent No. 2003-036907 disclosed a kind of technology that a flexible flat cable (FFC) can directly insert into and pull out from corresponding complementary connector. The conductors of the insert portion of the FFC directly electrically contact with the terminals received in the complementary connector, meeting the signal transmission between the FFC and the complementary connector. Whereas, some issues would appear as the implementations disclosed in the above public patent. When exerting greater insertion force to make the FFC engage with the complementary connector, the flat conductors of the insert portion and the terminals received in the complementary connector has relatively large contact area, thus, the friction there between is relatively increased, thus, the conductors get greater counterforce by the terminals, so the conductors would be easily turnovered or broken when insertion. As a result, normal electric connection would not be achieved between the FFC and the complementary connector, and as the conductors of the insert portion of the FFC are turnovered or broken, the FFC could not be used again, thus causing great losses. So we need an improved FFC to overcome the shortage of the existing technology.

BRIEF SUMMARY OF THE INVENTION

Accordingly, an object of the present invention is to provide a flexible flat cable to achieve convenient and reliable engagement and disengagement between the flexible flat cable and a complementary connector.

In order to achieve the above-mentioned object, a flexible flat cable in accordance with the present invention is adapted for mating with the complementary connector. The flexible flat cable comprises a plurality of conductors parallel disposed relative to one another; an insulation jacket covering said conductors defining a top surface and a bottom surface; and an insert portion formed at one end of the flexible flat cable with the conductors exposed outside the insert portion; and a chamfer is formed on the end of the conductors located in the insert portion.

Other objects, advantages and novel features of the invention will become more apparent from the following detailed description of the present embodiment when taken in conjunction with the accompanying drawings.

DETAILED DESCRIPTION OF THE INVENTION

Figure 1:
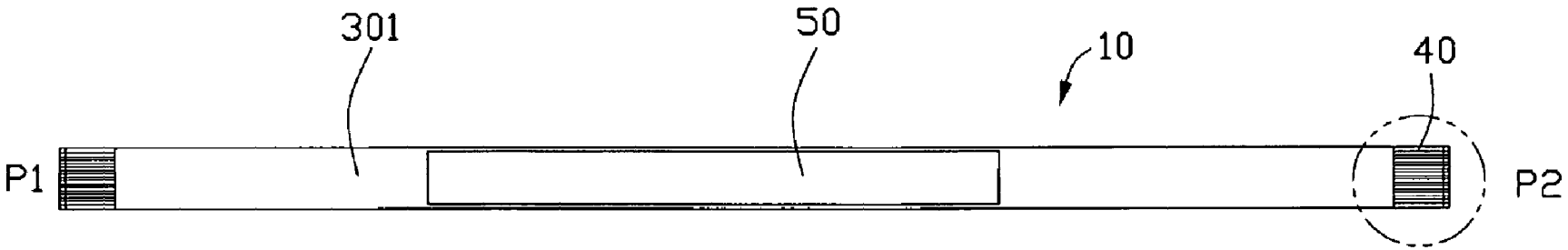
FIG. 1 is a top elevation view of a flexible flat cable in accordance with the present invention.

Reference will now be made to the drawing figures to describe the present invention in detail.

Figure 2:
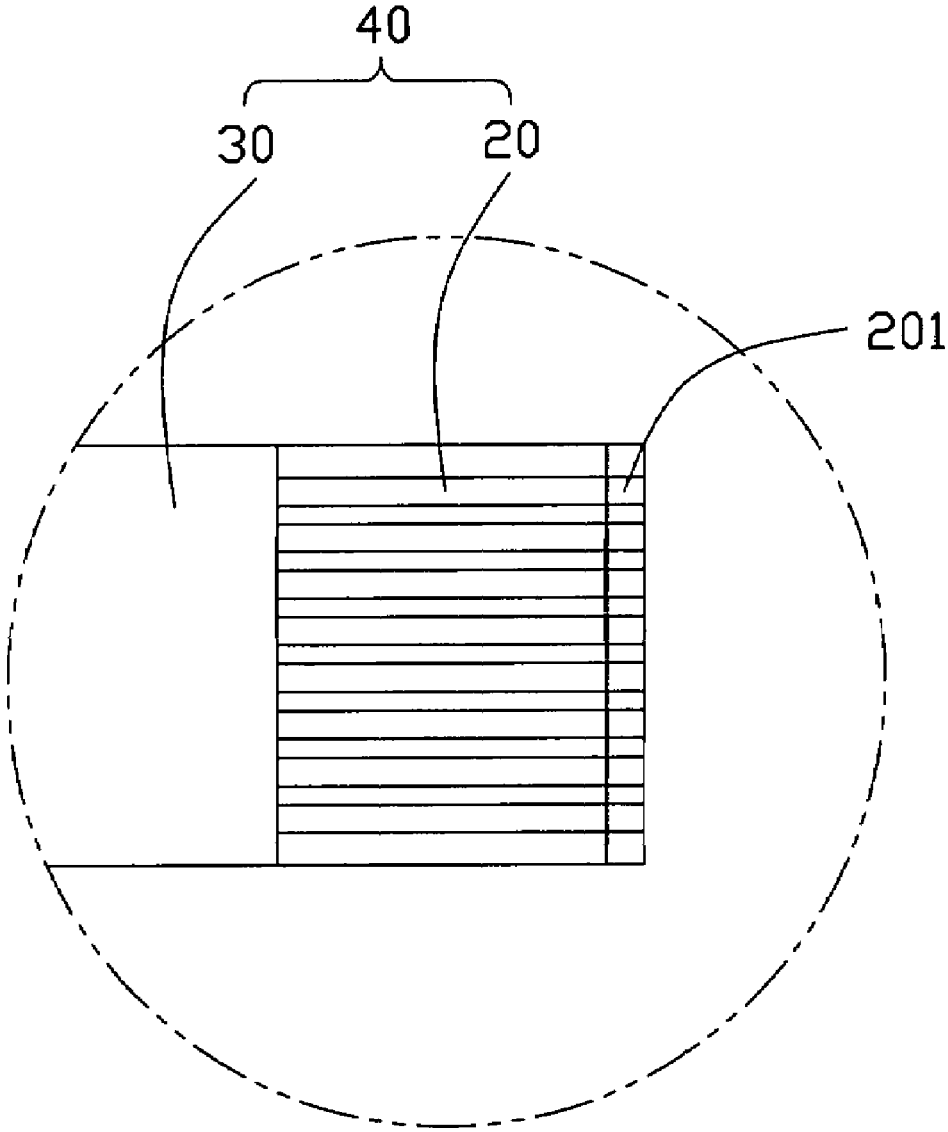
FIG. 2 is a partially enlarged view of the circled portion shown in FIG. 1.
Figure 3:
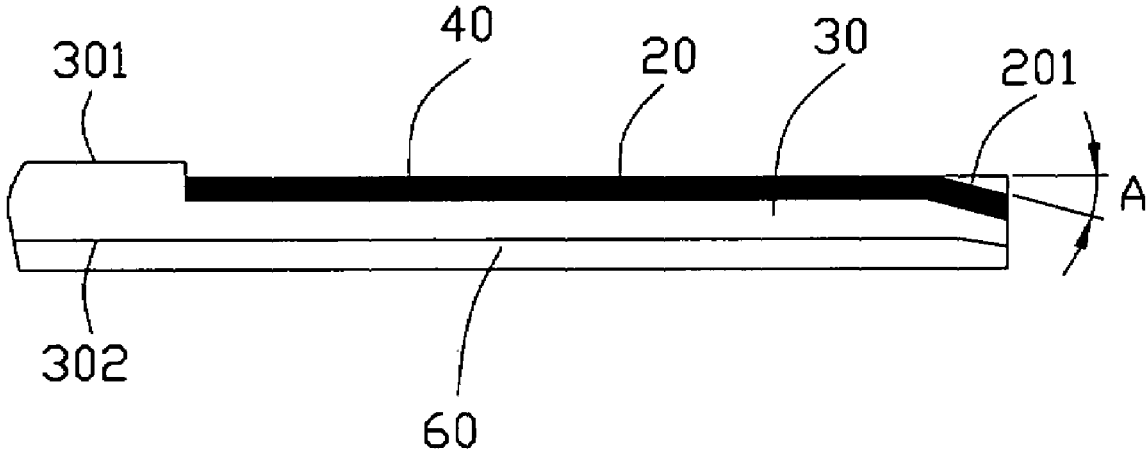
FIG. 3 is a partially enlarged view of FIG. 1, viewed from side elevation.

Referring to FIGS. 1-3, a flexible flat cable 10 comprises a plurality of flat conductors 20 parallelly disposed and an insulation jacket 30 covering opposite top and bottom surfaces of the flat conductors 20. The cross section of each flat conductor 20 is rectangular. The insulation jacket 30 could be a whole outer jacket integrated molding around the conductors via extrusion process, while the insulation jacket 30 could also include two layers laminated on the top and bottom surfaces of the conductors 20. The insulation jacket 30 defines a top surface 301 and an opposite bottom surface 302. A shielding layer 50 is sticked on the top surface 301, which is mainly used to prevent electromagnetic interference when signal transmission.

Now referring to FIGS. 1-2 and 4-5, a pair of insert portions 40 are formed on the two end sections P1, P2 of the flexible flat cable 10, which is capable of directly inserting into and pulling out from a complementary connector 70. The upper sides of the conductors 20 located at the insert portions 40 are not covered by the insulation jacket 30. A pair of reinforcing plates 60 are disposed on the bottom surface 302 of the insulation jacket 30 and adjacent to corresponding insert portions 40. Each reinforcing plate 60 comprises a horizontal portion 601 sticked on the bottom surface 302 below the insulation jacket 30 of the insert portion 40 for increasing the intensity of the insert portion 40, and the horizontal portion 601 is inserted into a receiving space 701 of the complementary connector 70 together with the insert portion 40. A flectional portion 602 is formed at free end of corresponding horizontal portion 601 and extends slantly from the free end of the horizontal portion 601 a certain distance, and an obtuse angle is thus formed between the horizontal portion 601 and the flectional portion 602. The flectional portion 602 makes the operator easy to hold the flexible flat cable 10 and easy to insert into and pull out from the complementary connector 70.

Figure 4:
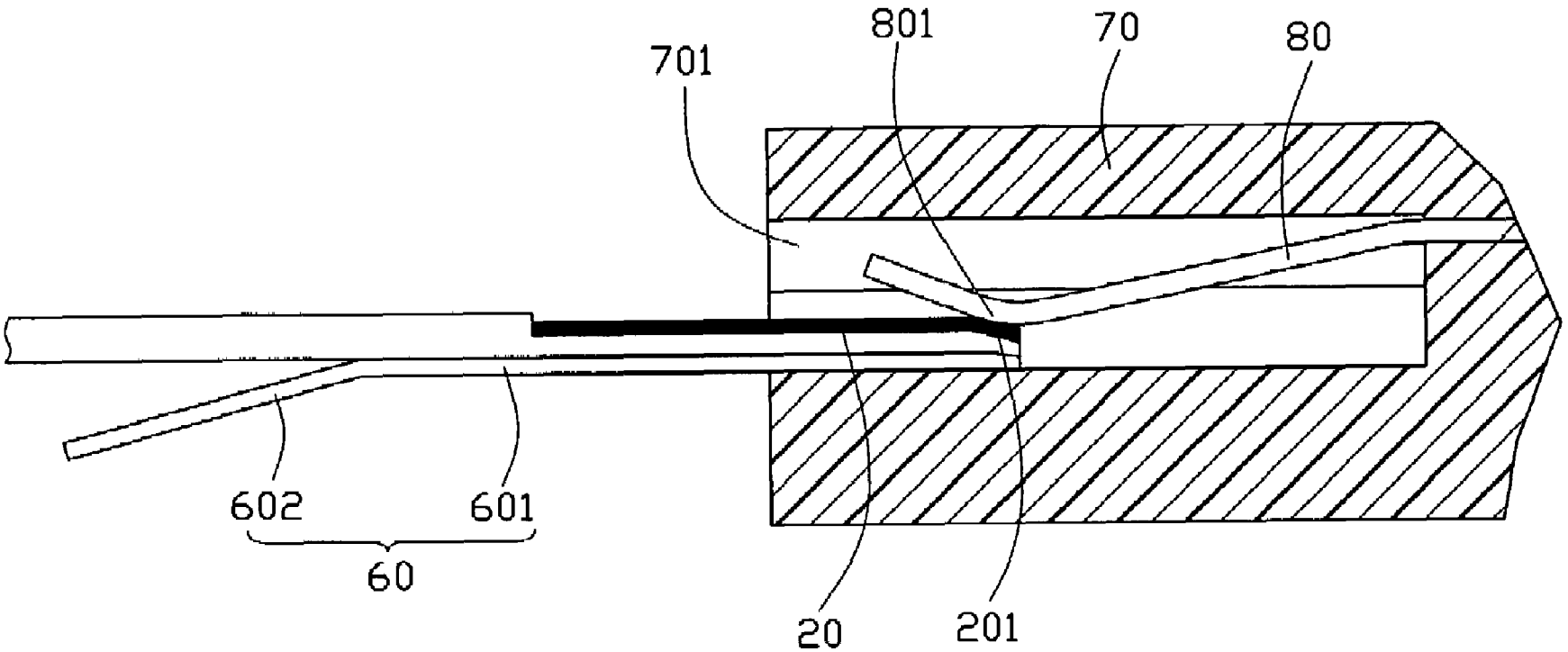
FIG. 4 is a cross-sectional view illustrating the flexible flat cable inserting into a complementary connector at the first stage.
Figure 5:
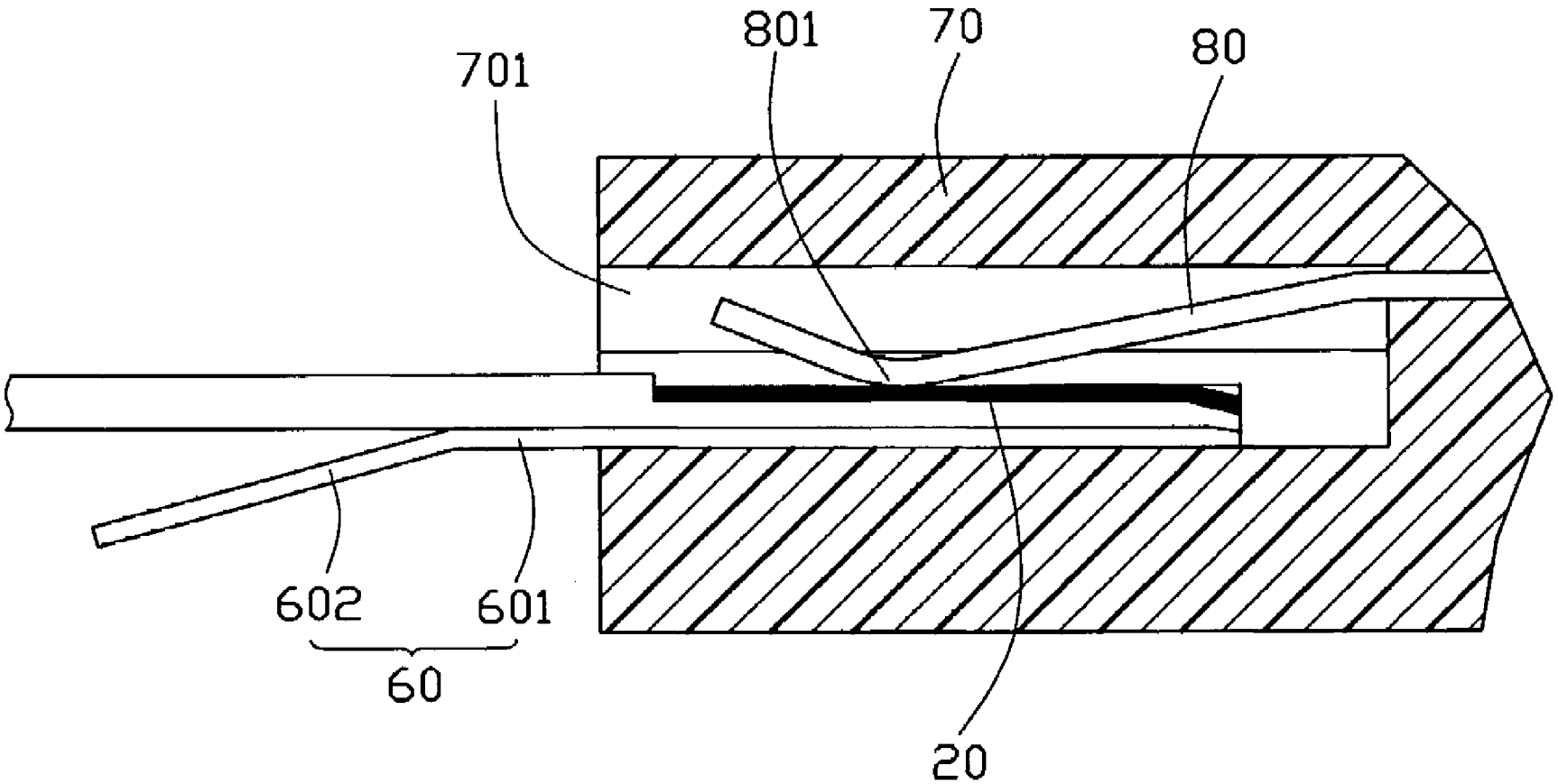
FIG. 5 is another cross-sectional view illustrating the flexible flat cable inserting into the complementary connector at middle stage.

Referring to FIGS. 3-5, through the secondary process by pressure, a chamfer 201 is formed on the end of the conductors 20 exposed outside, the function of guidance has been formed by the chamfer 201. The slant surface of the chamfer 201 has an angle (A) of approximately 15 to 30 degrees with the top surface of the conductors 20. The terminals 80 received in the complementary connector 70 each define a contact portion 801. When operator holds the flectional portion 602 to drive the flexible flat cable 10 to insert into the complementary connector 70, the contact portions 801 firstly contact with the chamfer 201 of the exposed conductors 20 of the insert portion 40. As the guiding function of the chamfer 201, the terminals 80 would be got very small friction, so the conductors 20 would not be turnovered or broken, the insert portion 40 of the flexible flat cable 10 conveniently and reliably engages with the complementary connector 70 and thus achieving perfect electric connection there between. When operator holds the flectional portion 602 of the reinforcing plate 60 and exerts rearward horizontal force to the flectional portion 602, the flexible flat cable 10 is pulled out from the complementary connector 70, thus, the insert portion 40 of the flexible flat cable 10 is pulled out from the receiving space 701 of the complementary connector 70.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A flexible flat cable adapted for mating with a complementary connector, comprising:

a plurality of conductors parallel disposed relative to one another and defining a top surface, each conductor having a rectangular cross section;

an insulation jacket covering said conductors and defining a top surface and a bottom surface; and an insert portion formed at one end of the flexible flat cable with front portions of the conductors exposed outside the top surface of the insulation jacket;

and wherein the front portion of each conductor defines at a front free end thereof a chamfer on the top surface thereof.

2. The flexible flat cable as claimed in claim 1, wherein the slant surface of the chamfer has an angle of approximately 15 to 30 degrees with the top surface of the conductors.

3. The flexible flat cable as claimed in claim 1, further comprising a reinforcing plate disposed on the bottom surface of the insulation jacket below the insert portion, and wherein the reinforcing plate comprises a horizontal portion and a flectional portion extending rearwardly from a rear end of the horizontal portion, and wherein a certain angle is formed between the horizontal portion and the flectional portion.

4. The flexible flat cable as claimed in claim 3, wherein the certain angle is more than 90 degrees.

5. The flexible flat cable as claimed in claim 1, wherein the insulation jacket comprises two layers laminated on the top and bottom surfaces of the conductors.

6. The flexible flat cable as claimed in claim 1, wherein the insulation jacket is integrally extruded around the conductors to enclose the conductors therein.

7. The flexible flat cable as claimed in claim 1, further comprising a shielding layer sticked on the top surface of the insulation jacket.

8. A flexible flat cable assembly comprising:

a plurality of conductors extending along a lengthwise direction in parallel relation with one another;

an insulative layer covering said conductors on two opposite surfaces while exposing front portions of said conductors on one of said surfaces; and a distal front end section of each of said conductors along the lengthwise direction being deflected to form a chamfer at a tip thereof while the insulative layer not, so as to result in not only a lower insertion force with regard to the conductor along the lengthwise direction when the cable is inserted into a complementary connector but also lateral restriction with regard to the conductor.

9. The flexible flat cable assembly as claimed in claim 8, wherein each conductor has a rectangular cross section.

10. The flexible flat cable assembly as claimed in claim 8, further comprising a shielding layer attached on a surface of the insulation layer.

11. The flexible flat cable assembly as claimed in claim 10, wherein said shielding layer forwardly extends flush with the tip of the distal front end section of each of the conductors.

12. The flexible flat cable assembly as claimed in claim 8, further including a complementary defining an insulative housing with a receiving space into which said insulative layer and said conductors are received, wherein said connector includes a plurality of resilient terminals pressing the front portions of the corresponding conductors and insulative layer against the housing.

13. The flexible flat cable assembly as claimed in claim 12, wherein said front portions extend in a straight manner in said receiving space.

* * * * *